US005465762A

United States Patent [19]

Farley

[11] Patent Number: 5,465,762

[45] Date of Patent: Nov. 14, 1995

[54] ADJUSTABLE REED FOR WEAVING NET-SHAPED TAILORED FABRICS

[75] Inventor: Gary L. Farley, Yorktown, Va.

[73] Assignee: The United States of America as represented by the Administrator of the National Aeronautics and Space Administration, Washington, D.C.

[21] Appl. No.: 260,162

[22] Filed: Jun. 10, 1994

[51] Int. Cl.[6] ..... D03D 49/68

[52] U.S. Cl. ..... 139/192

[58] Field of Search ..... 28/190; 139/11, 139/192, 48, 189, 191, 188 A, 29

[56] References Cited

U.S. PATENT DOCUMENTS

| | | | |
|---|---|---|---|
| 212,120 | 2/1979 | Adamson . | |
| 223,974 | 2/1880 | Adamson . | |
| 627,440 | 6/1899 | Patrone | 139/48 |
| 902,286 | 10/1908 | Garst | 139/11 |
| 2,396,974 | 3/1946 | Turner . | |
| 3,132,671 | 5/1964 | Koppelman et al. | 139/11 |
| 4,958,664 | 9/1990 | Oppl et al. . | |
| 5,058,628 | 10/1991 | Spiller et al. . | |
| 5,067,215 | 11/1991 | Behl et al. . | |
| 5,158,116 | 10/1992 | Kazuo et al. . | |

FOREIGN PATENT DOCUMENTS

| | | | |
|---|---|---|---|
| 0586959 | 3/1994 | European Pat. Off. | 139/192 |
| 3220343 | 9/1991 | Japan | 139/11 |

*Primary Examiner*—Andy Falik

*Attorney, Agent, or Firm*—Linda B. B. Blackburn; George F. Helfrich

[57] ABSTRACT

An apparatus and method for forming woven fabrics through the use of an adjustable reed. The adjustable reed has multiple groups of reed wires that guide the warp yarns. The groups of reed wires move on reed rails parallel to the warp direction. In addition, rail expanders permit the space between the reed wires to be modified and telescoping rods attached to the rail sliders can be turned to permit the reed wires to be skewed to alter the fill yarn angle. These adjustments to the reed permit simultaneous variation of fill yarn angles and fabric widths and allow these variations to be made during fabrication, without the need to halt production.

27 Claims, 7 Drawing Sheets

ADJUSTABLE REED FOR WEAVING NET-SHAPED TAILORED FABRICS

ORIGIN OF THE INVENTION

The invention described herein was made by an employee of the United States Government and may be manufactured and used by or for the Government for governmental purposes without the payment of any royalties thereon or therefor.

BACKGROUND OF THE INVENTION

1. Field of the Invention

The present invention relates generally to weaving and more particularly to an adjustable reed capable of tailoring the fill yarn angle and width of woven fabrics.

2. Description of the Related Art

The traditional role of the reed in the weaving of net-shaped fabrics is to tailor the fill yarn angle, control the width of the fabric and beat the fill yarn into the fell of the fabric. Increased flexibility in the design and fabrication of fabrics could be obtained if the ability to control the location of each reed wire were achieved. Conventional reeds, including fixed reeds and width adjustable reeds offer some flexibility in fabrication, but are still severely limited.

Fixed reeds such as fan reeds, in which the shape of the reed is unalterable, typically have been used to tailor fabric width. However, the fixed reed constrains the tailoring of fabric width based upon the fixed reed's original shape since the location of the warp yarn is set by the design of the reed. This makes use of such reeds impracticable or impossible in applications where the design requires a high level of tailorability. Even where it is possible to produce the desired fixed reed geometry, the reed may only be applicable to that specific application. Producing new reeds for each application is expensive and time consuming especially when prototyping a new structure where a design may still be in a state of flux. Adjustable width reeds are known, but offer only limited variations in reed spacing. U.S. Pat. No. 5,067,215 to Behl et al. discloses an expanding reed comprised of a number of hinged points which can be moved in a guide to uniformly pull apart the individual reed teeth to a greater or lesser extent to change the width of a yarn sheet. U.S. Pat. No. 5,158,116 to Kazuo et al. discloses several means for moving dents toward and away from each other, including: 1) a guide plate with a pattern of elongated slits to guide the dents, 2) an expander in which individual dents are mounted to crossing portions, and 3) an elastic member to which individual dents are attached at equal intervals.

The ultimate in tailorability of fill yarn angle and fabric width would require the ability to dynamically change the location of each individual reed wire during the weaving process. However, for most structural applications it would be more practical to control the position of groups of reed wires. In the present invention, reed wires are grouped and each group can be moved parallel and perpendicular to the warp yarns. The profile of the reed wires within the groups can be skewed to tailor fill yarn fiber angle and the reed wires within each group can be simultaneously spread or contracted to locally control fabric width. In addition, the spacing between reed groups can be individually varied. This dual capability to vary fill yarn angle and fabric width does not exist in typical fixed reeds or adjustable width reeds. Presently, if variations of width or fill yarn angle are desired in a finished article it is generally necessary to exchange reeds or halt the production to adjust the reed.

The tailorability possible with the present invention may offer benefits in the fabrication of a variety of materials. Laminated composite materials have typically been difficult to fabricate because they exhibit many unique failure modes. Delamination induced failures initiated at the free edge of the composite laminate are frequently produced. This failure is created from the high interlaminar stresses that only occur adjacent to the free edge. The creation and magnitude of these interlaminar stresses near the free edge can be partially attributed to the mismatch in Poisson's ratio between adjacent layers of material having different fiber orientation. The ability to tailor the fiber angle in each layer near the free edge could result in a significant reduction in the magnitude of these interlaminar and intralaminar stresses. Utilizing the adjustable reed of the present invention, it will be possible to readily tailor the fiber orientation of each layer at the free edge.

An adjustable reed with the ability to control the fiber angle and fabric width dynamically during the weaving process greatly increases the level of tailoring that is achievable by facilitating the simultaneous local tailoring of fill yarn angle and fabric width along the length of the fabric. This adjustability results in higher levels of structural efficiency and reduced structural cost through more optimal use of materials and the elimination of the need for secondary steps such as cutting. An adjustable reed will also significantly reduce material prototyping cost because new reeds will not have to be produced for each design and through reducing setup time required to redraw the warp yarns through the loom.

SUMMARY OF THE INVENTION

It is accordingly an object of the present invention to form fabrics using an adjustable reed wherein the fill yarn angle can be modified.

It is another object of the present invention to form fabrics using an adjustable reed wherein the fill yarn angle can be modified during fabrication without the need to halt production to adjust the reed.

It is another object of the present invention to form fabrics using an adjustable reed to modify the fabric width.

It is another object of the present invention to form fabrics using an adjustable reed to modify the fabric width during fabrication without the need to halt production to adjust the reed.

It is another object of the present invention to form fabrics using an adjustable reed by simultaneously controlling the local fill yarn fiber angle and the fabric width.

It is another object of the present invention to form fabrics using an adjustable reed wherein the fill yarn fiber angle and the fabric width can be modified simultaneously and continuously during fabrication, without the need to halt production to adjust the reed.

The above and numerous other objects are achieved by an adjustable reed which generally includes a reed frame which supports a number of reed groups. Each reed group has a number of slotted reed wires which are supported on reed wire sliders. The reed wire sliders are supported by reed wire rails and are capable of movement along the reed wire rails. Fill yarns are positioned within the slots of the reed wires. The position of the fill yarns can be modified by motion of the sliders which can be translated as a group or skewed to create a local change in fill yarn angle. The width of the fabric can be changed by spreading the reed rails which support the reed wire sliders.

The flexibility in adjusting the fill yarn angle by translation or skewing of the reed wire sliders, combined with the ability to modify fabric width by spreading of the reed wire rails, permits the formation of a variety of net shape fabrics with desired mechanical properties related to fill yarn angle. This adjustable reed offers the additional advantage of being able to modify fabric width and fill yarn angle without the need to halt production, i.e., it is not necessary to stop production to exchange reeds of various designs in order to get various configurations in the finished fabric.

BRIEF DESCRIPTION OF THE DRAWINGS

Other objects, features and advantages of the present invention will become more fully apparent from the following detailed description of the preferred embodiment, the appended claims and the accompanying drawings, in which:

FIG. 3(*b*) is a side view of a reed wire group.

FIG. 4(*b*) is a top view of reed wire sliders mounted on reed rails and skewed with respect to each other.

FIG. 5(*b*) is a top view of a retracted end bracket.

FIG. 6(*b*) is a top view of a retracted end bracket with reed rails.

FIG. 7(*b*) is a top view of a retracted end bracket with rail expanders.

DESCRIPTION OF THE PREFERRED EMBODIMENTS

Figure 1:
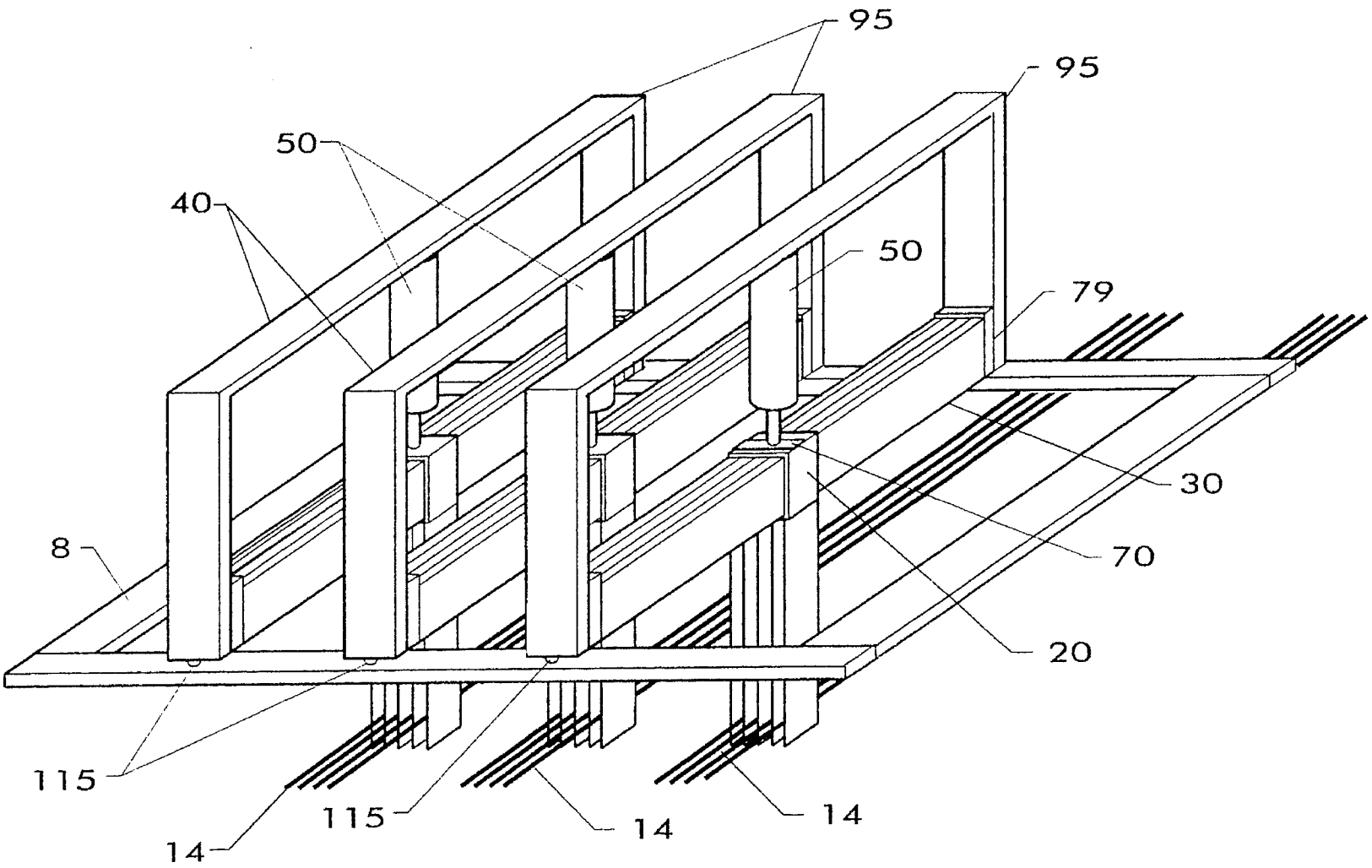
FIG. 1 is a perspective view of a reed frame with three reed groups in accordance with this invention.

Referring to FIG. 1, an adjustable reed includes a reed frame 8 which supports a plurality of reed group frames 95. Each reed group frame 95 is comprised of two elongated, vertical end pieces. Each of the end pieces is connected at the top to a linear actuator 40 which is any conventional device that converts power, such as electric, pneumatic or hydraulic, into linear motion. Interposed between each bottom portion of each end piece and the top surface of the reed frame 8 is a bearing 115, such that the reed group frame 95 can move along parallel to the edge of the reed frame 8 upon which it is supported. A plurality of reed rails 30 are expandably connected to the inner face of each of the reed group frames 95. Details of the expanding means 79 are provided below in reference to FIGS. 5–7. A rail slider 20 is slidably disposed on each reed rail 30. The tops of each rail slider 20 within each reed group frame 95 are rotatably interconnected by a telescoping rod 70. A reed wire 10 is attached to the bottom of each rail slider 20 and hangs beneath it. A fiber angle motor 50 is connected at one end to the linear actuator 40 and is rotatably connected at the other end to the telescoping rod 70 whereby movement of the linear actuator 40 pulls the fiber angle motor 50 parallel to the length of the reed rails 30, along with the reed wires 10 and rail sliders 20 which are attached to the telescoping rod 70.

For illustration purposes only, three reed group frames 95 are shown, with each reed group frame 95 holding a group of five reed rails 30 which support a corresponding number of rail sliders 20 with attached reed wires 10. The number of reed group frames 95 may vary to accomodate fabrication of a specific fabric. In addition, the number of rail sliders 20 with attached reed wires 10 in each group may vary. Although the preferred embodiment illustrates a group with five reed: wires 10 spaced at about four wires per inch, any number of reed wires 10 may be used at any convenient spacing sufficient to produce a fabric of a desired width with the desired fill yarn angle.

Figure 2:
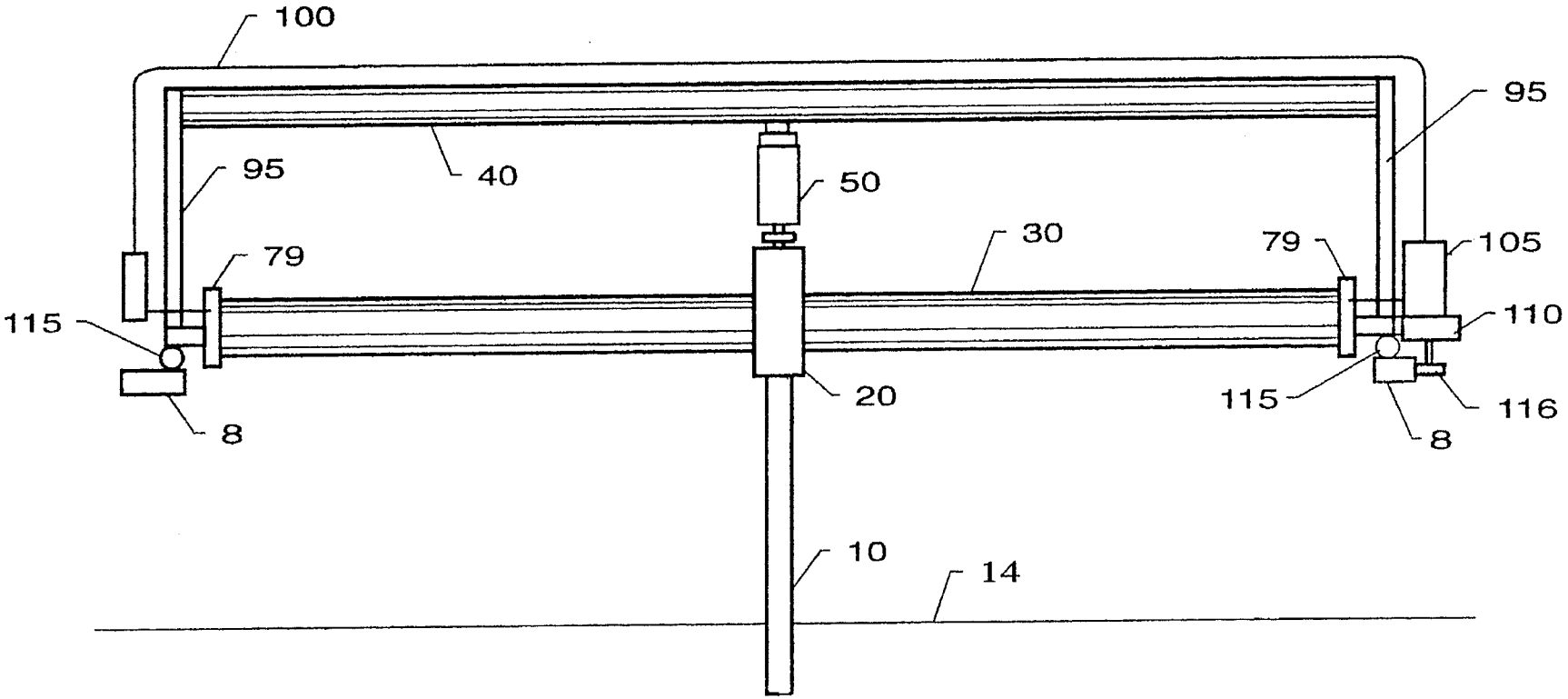
FIG. 2 is a side view of a reed group mounted in a reed frame.

Referring now to FIG. 2, rail expanding means 79 are interconnected between each reed rail 30 and the reed group frame 95. Details of the expanding means are discussed below in reference to FIGS. 5–7. Each expanding means 79 is connected to a rail spreader motor 105 by means of a shaft 100, such that rotation of the shaft causes the expanding means 79 to expand or contract to vary the distance between the reed rails 30 within each reed group. A reed group motor 110 is attached to one end of each reed group frame 95. The lower end of the reed group motor 110 is attached to a bearing 116 which interacts with a worm gear (not shown) attached to the outer edge of one side of the reed frame 8 along which the reed group frame 95 travels, such that activation of the reed group motor 110 causes the reed group frame 95 to travel along the edge of the reed frame 8.

Figure 3B:
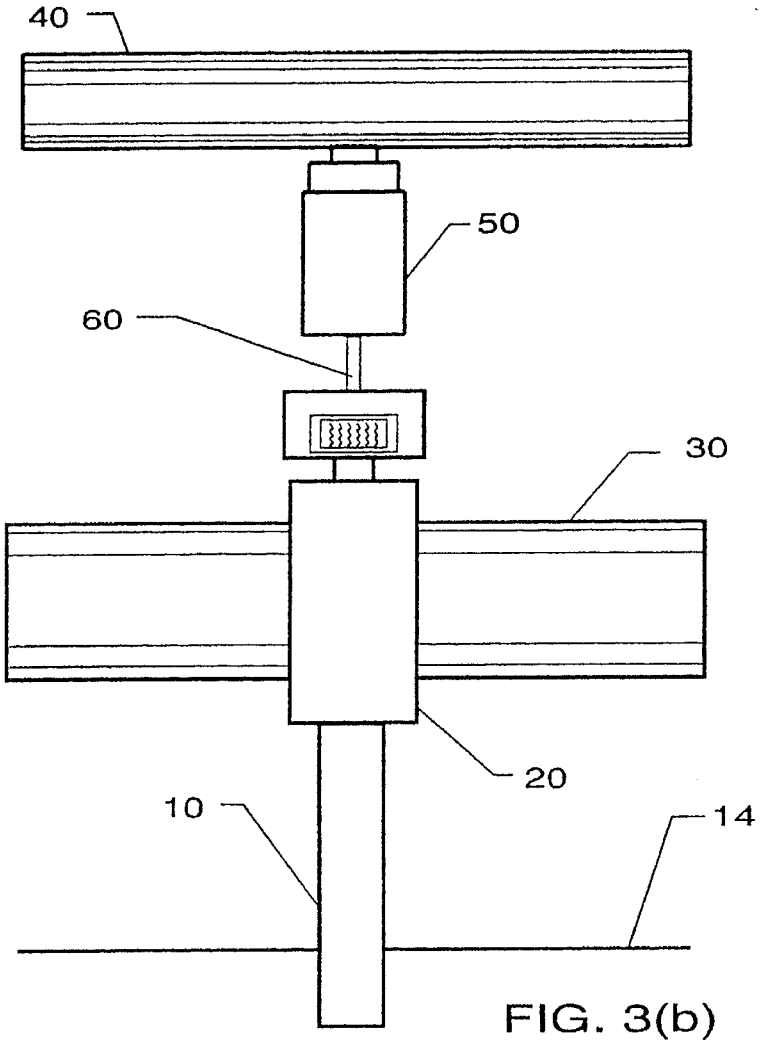
FIG. 3(*a*) is an end view of a reed wire group.
Figure 3A:
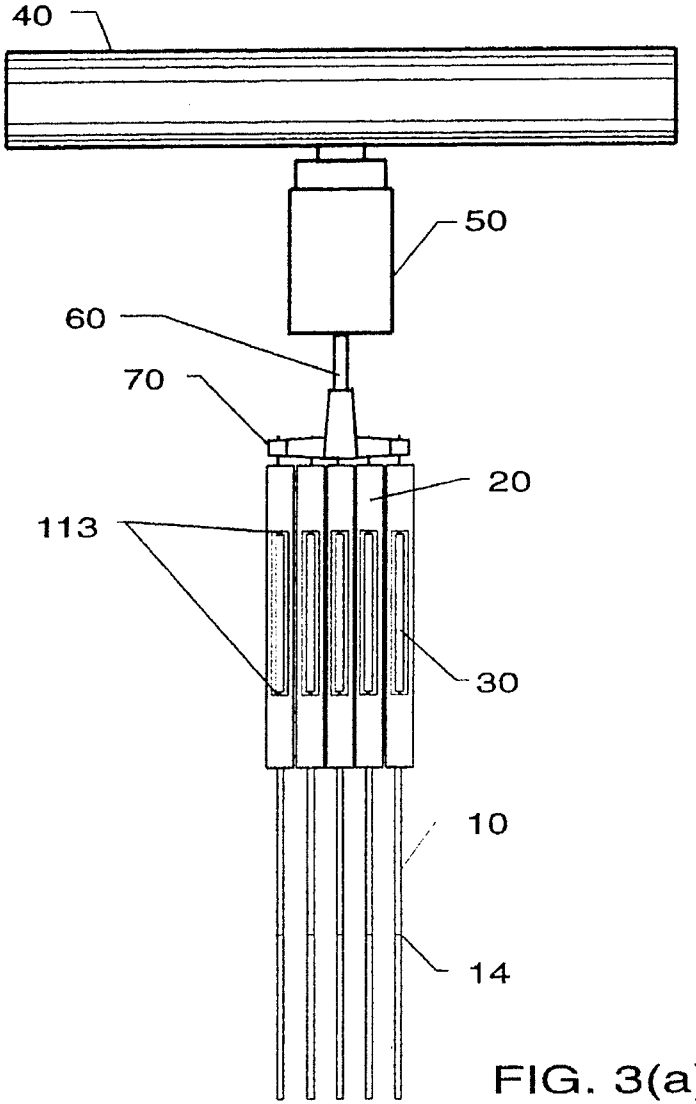

As illustrated in FIGS. 3(*a*) and 3(*b*), each rail slider 20 within a reed group is rotatably connected by a link means 60 to a telescoping rod 70. The rail sliders 20 are slotted to accomodate the reed rails 30 and slider bearings 113 are interposed between the rail sliders 20 and the reed rails 30 to facilitate movement of the rail sliders 20 along the reed rails 30. The reed wires 10 are suspended beneath the rail sliders 20 and are slotted to accomodate the warp yarns 14. In alternate embodiments of the present invention, the reed wires 10 may be substantially solid with the warp yarns 14 positioned between and guided by the reed wires 10 or there may be a combination or slotted and solid wires with warp yarns positioned both in the slots and between the wires.

Figure 4A:
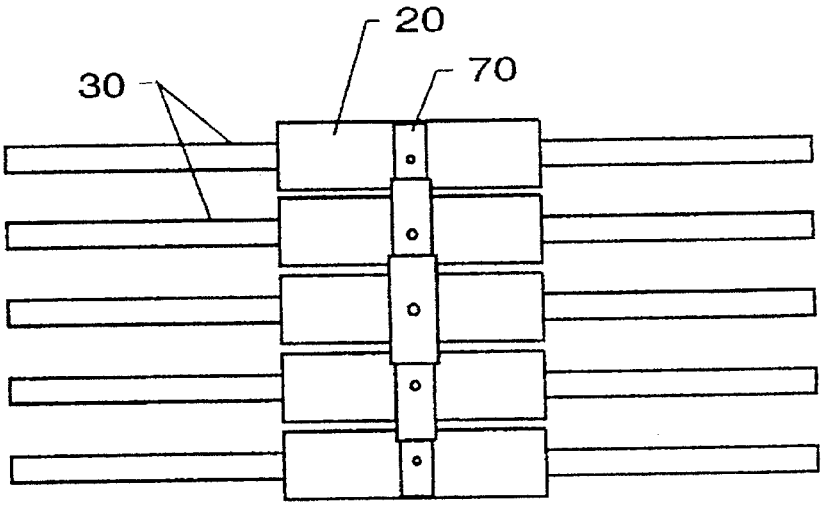
FIG. 4(*a*) is a top view of reed wire sliders mounted on reed rails.
Figure 4B:
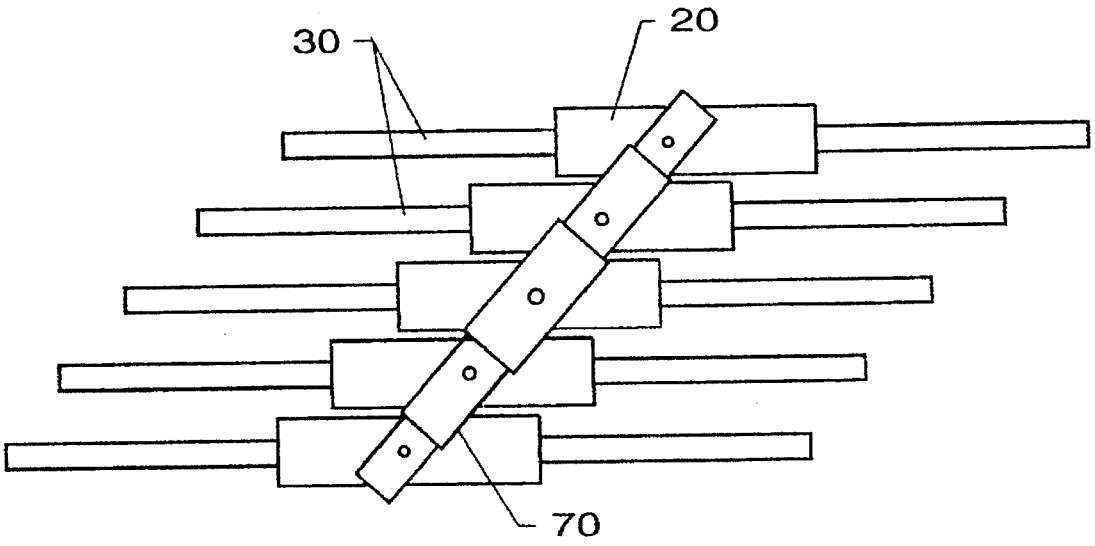

As shown in FIGS. 4(*a*) and 4(*b*), each reed slider 20 is connected to a segment of a telescoping rod 70. The telescoping rod 70 is further connected at the center segment of the rod to the fiber angle motor 50, as shown in FIGS. 3(*a*) and 3(*b*). Activation of the fiber angle motor 50 causes rotation of the center segment and expansion of the telescoping rod 70 which results in skewing of the rail sliders 20 on the reed rails 30 to produce variations in fiber yarn angle. Regardless of whether the telescoping rod 70 is expanded or contracted, the reed sliders 20 attached to the telescoping rod 70 are moved along the reed rails 30 as a group as the fiber angle motor 50 is pulled along the linear actuator 40.

Figure 5A:
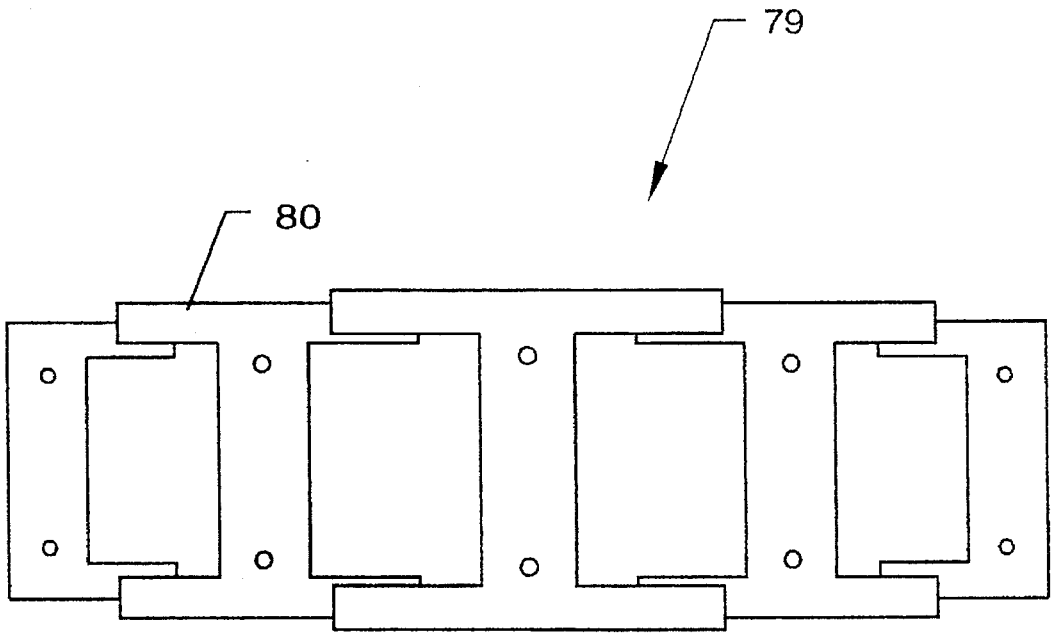
FIG. 5(*a*) is a top view of an expanded end bracket.
Figure 5B:
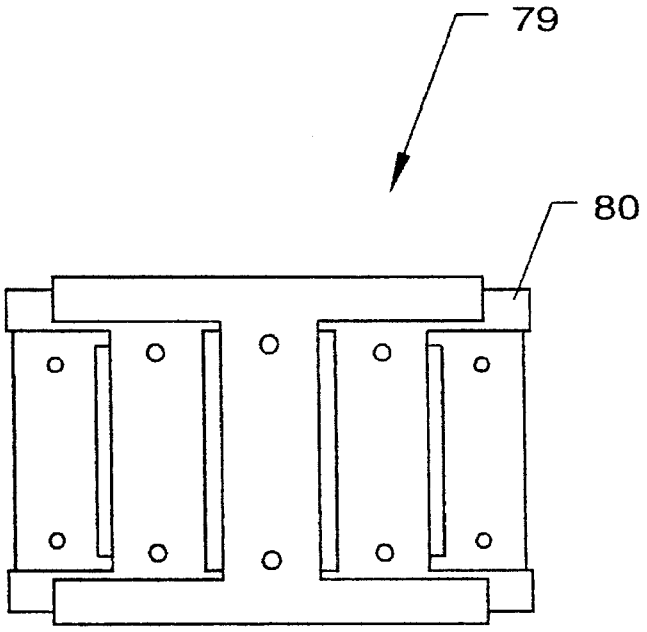
Figure 6A:
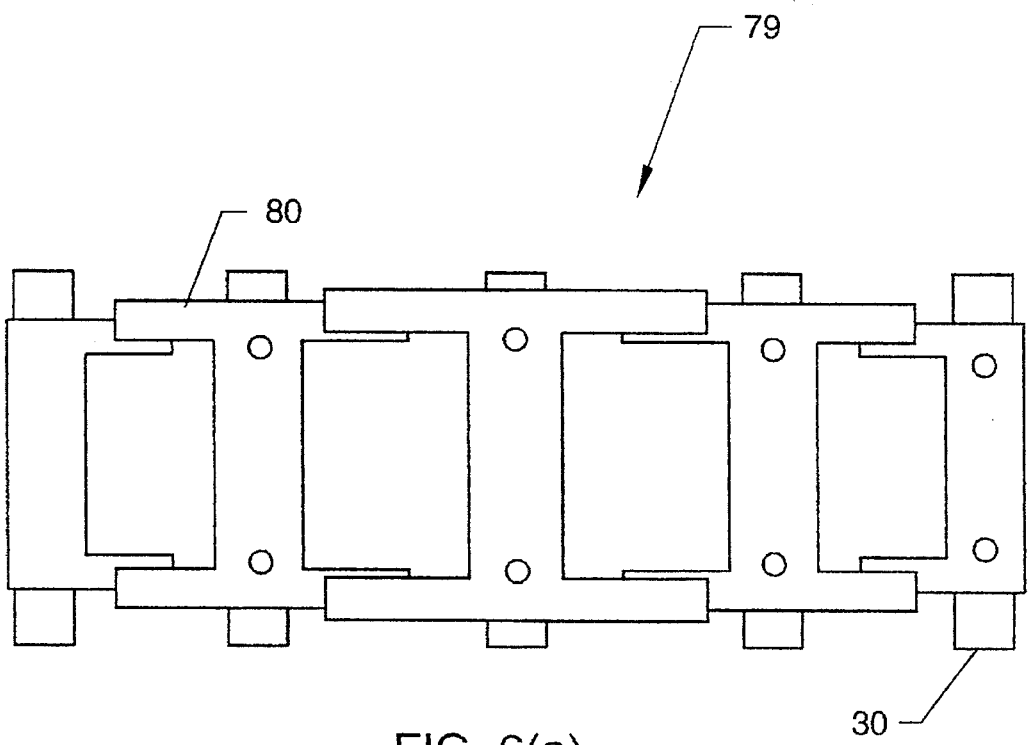
FIG. 6(*a*) is a top view of an expanded end bracket with reed rails.
Figure 6B:
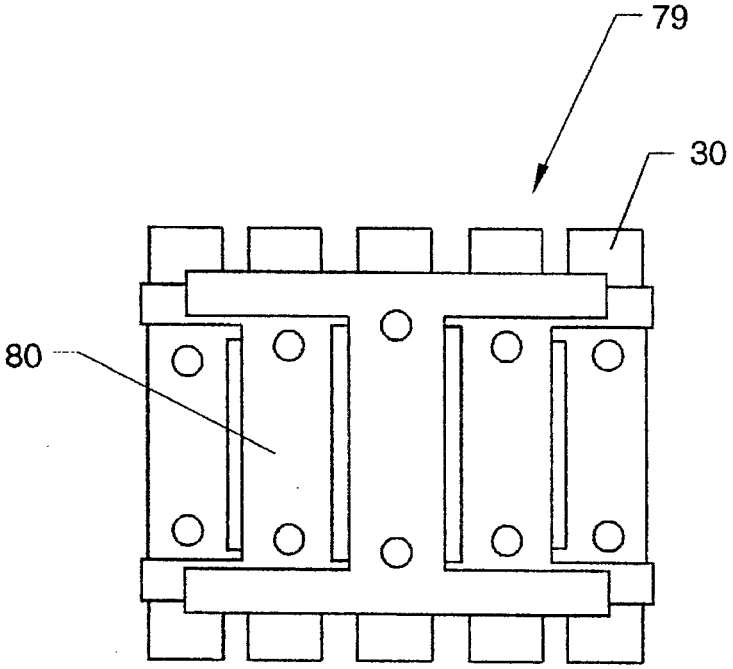
Figure 7A:
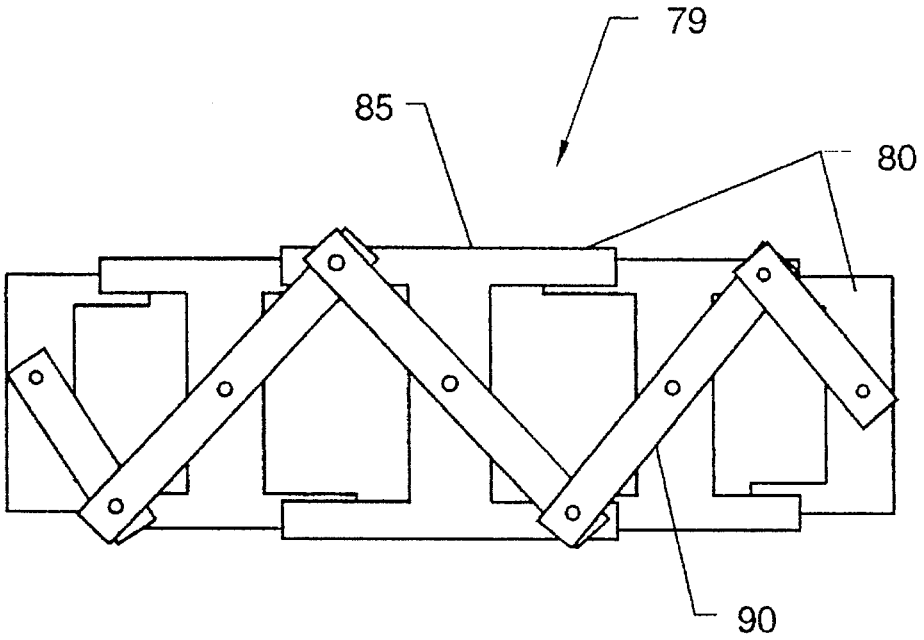
FIG. 7(*a*) is a top view of an expanded end bracket with rail expanders.
Figure 7:
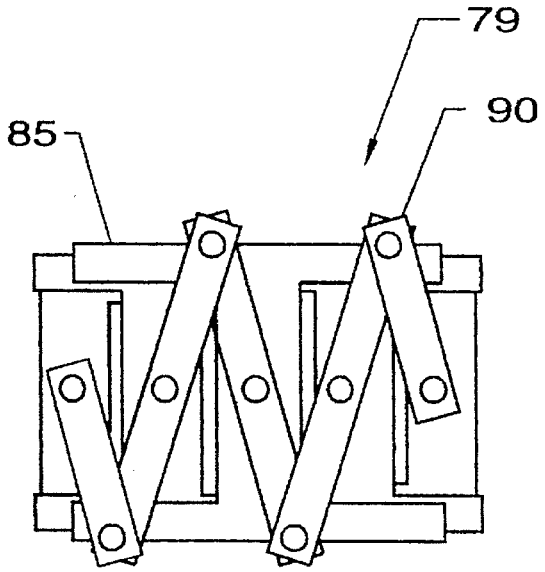

The expanding means 79 is shown in FIGS. 5–7 and is comprised of a telescoping end bracket 80 and rail expanders 90. A telescoping end bracket 80 is interposed between the reed group frame 95 and is attached at each end of each reed rail 30 within each reed rail group. The telescoping end bracket 80 has a segment attached to each reed rail 30 to keep the reed rails 30 in a vertical position and to facilitate the spacing of the reed rails 30. A hinged, segmented rail expander 90 is rotatably attached to each segment of the telescoping end bracket 80. The rail spreader motor 105, see FIG. 2, is attached to the center segment of the rail expander 90, such that as the motor 105 turns, the center segment of the rail expanders 90 rotate causing the end bracket 80 to expand or contract laterally.

The operation of all the motors disclosed in the above illustration of the preferred embodiment can be controlled by any convenient, conventional means, ranging from manual to computer control.

While the present invention has been disclosed in connection with the preferred embodiment thereof, it should be understood that there may be other embodiments which fall within the spirit and scope of the invention. All such modifications are intended to be encompassed within the following claims.

What is claimed is:

1. An adjustable reed for weaving warp and fill yarn fibers into fabrics, comprising:

a reed frame having at least two substantially parallel sides;

a plurality of group frames wherein each group frame further comprises:

at least two substantially vertical end legs, each leg having a top end, a bottom end and an inner surface; and a linear actuator interconnecting the two end legs near the top ends of each end leg, and the bottom of the end legs of the reed group frame are movably disposed on the reed frame;

a plurality of reed rails wherein each reed rail is mounted at each end to the inner surface of each of the end legs of the group frames such that each group frame contains a plurality of reed rails;

a plurality of reed sliders wherein each reed slider is slidably mounted on a corresponding reed rail;

a plurality of reed wires wherein each reed wire is attached to a corresponding reed slider such that the reed wires extend below the reed sliders and are interposed between the warp yarns to guide the warp yarns during weaving;

means interconnecting the rail sliders within each group frame such that the rail sliders within each group frame move along the length of the rails in unison;

means interconnecting the linear actuator and the rail slider interconnecting means such that activation of the linear actuator causes the rail sliders within the group frame to be pulled along the lengths of the reed rails; and means for moving each group frame along the reed frame in a direction perpendicular to the warp yarn axis to vary warp yarn spacing during weaving.

2. The adjustable reed of claim 1, wherein the means for moving each group frame comprises:

a first gear attached along the length of one parallel side of the reed frame;

a plurality of group frame motors wherein each motor is attached to a corresponding outer edge of an end leg of each group frame; and a second gear rotatably attached to the group frame motor and engaging the first gear such that energizing the motor causes rotation of the second gear, thereby moving the group frame along the reed frame in a direction perpendicular to the warp yarn axis.

3. The adjustable reed of claim 1, wherein each reed wire is slotted to accomodate and guide a warp yarn during weaving.

4. An adjustable reed for weaving warp and fill yarn fibers into fabrics, comprising:

a reed frame having at least two substantially parallel sides;

a plurality of group frames wherein each group frame further comprises:

at least two substantially vertical end legs, each leg having a top end, a bottom end and an inner surface; and a linear actuator interconnecting the two end legs near the top ends of each end leg, wherein the bottom of the end legs of the reed group frame are attached to the reed frame;

a plurality of reed rails wherein each reed rail is expandably mounted at each end to the inner surface of each of the end legs of the group frames such that each group frame contains a plurality of reed rails;

a plurality of reed sliders wherein each reed slider is slidably mounted on a corresponding reed rail;

a plurality of reed wires wherein each reed wire is attached to a corresponding reed slider such that the reed wires extend below the reed sliders and are interposed between the warp yarns to guide the warp yarns during weaving;

means interconnecting the rail sliders within each group frame such that the rail sliders within each group frame move along the length of the rails in unison;

means interconnecting the linear actuator and the rail slider interconnecting means such that activation of the linear actuator causes the rail sliders within the group frame to be pulled along the lengths of the reed rails; and means for expanding the reed rails within each group frame in a direction perpendicular to the warp yarn axis.

5. The adjustable reed as in claim 4, wherein the means for expanding the rails comprises:

a plurality of rail spreader motors, wherein each rail spreader motor is attached to a corresponding group frame;

a plurality of telescoping brackets wherein each bracket has a plurality of slidable segments forming an inner surface and an outer surface and each slidable segment comprising the bracket is attached on the inner surface to an end of a corresponding reed rail within a group frame such that each group frame has a telescoping bracket at each end of the reed rails;

a plurality of rail expanders, each rail expander having a plurality of hinged segments forming an inner surface and an outer surface, wherein each hinged segment of a rail expander is rotatably connected at the inner surface of the hinged segment to the outer surface of the corresponding telescoping bracket segment, such that each telescoping bracket has a corresponding rail expander, whereby rotation of any hinged segment expands the rail expander laterally; and interconnecting means between at least one hinged segment of each rail expander and the corresponding rail expander motor for each group frame, for rotating that hinged segment of the rail expander such that the rail expander expands laterally.

6. The adjustable reed of claim 4, wherein each reed wire is slotted to accomodate and guide a warp yarn during weaving.

7. An adjustable reed for weaving warp and fill yarn fibers into fabrics, comprising:

a reed frame having at least two substantially parallel sides;

a plurality of group frames wherein each group frame further comprises:

at least two substantially vertical end legs, each leg having a top end, a bottom end and an inner surface; and a linear actuator interconnecting the two end legs near the top ends of each end leg, wherein the bottom of the end legs of the reed group frame are attached to the reed frame;

a plurality of reed rails wherein each reed rail is mounted at each end to the inner surface of each of the end legs of the group frames such that each group frame contains a plurality of reed rails;

a plurality of reed sliders wherein each reed slider is slidably mounted on a corresponding reed rail;

a plurality of reed wires wherein each reed wire is attached to a corresponding reed slider such that the reed wires extend below the reed sliders and are interposed between the warp yarns to guide the warp yarns during weaving;

means interconnecting the rail sliders within each group frame such that the rail sliders within each group frame move along the length of the rails in unison;

means interconnecting the linear actuator and the rail slider interconnecting means such that activation of the linear actuator causes the rail sliders within the group frame to be pulled along the lengths of the reed rails; and means for skewing the relative positions of the rail sliders within each reed rail group.

8. The adjustable reed as in claim 7, wherein the means interconnecting the rail sliders within each group frame is a telescoping rod having a plurality of slidable segments, wherein each segment is rotatably connected to a corresponding reed slider; and wherein the skewing means further comprises:

a skewing motor attached to the linear actuator such that activation of the linear actuator pulls the skewing motor along the length of the linear actuator; and means interconnecting the motor and a segment of the telescoping rod for turning the attached rod segment when the motor is energized, whereby rotation of the attached rod segment expands the telescoping rod to skew the sliders on the reed rails, thereby varying the relative positions of the attached reed wires to modify the fill yarn angle.

9. The adjustable reed of claim 7, wherein each reed wire is slotted to accomodate and guide a warp yarn.

10. An adjustable reed for weaving warp and fill yarn fibers into fabrics, comprising:

a reed frame having at least two substantially parallel sides;

a plurality of group frames wherein each group frame further comprises:

at least two substantially vertical end legs, each leg having a top end, a bottom end and an inner surface; and a linear actuator interconnecting the two end legs near the top ends of each end leg, wherein the bottom of the end legs of the reed group frame are movably disposed on the reed frame so that each group frame moves along the reed frame in a direction perpendicular to the warp yarn axis;

a plurality of reed rails wherein each reed rail is expandably mounted at each end to the inner surface of each of the end legs of the group frames such that each group frame contains a plurality of reed rails;

a plurality of reed sliders wherein each reed slider is slidably mounted on a corresponding reed rail;

a plurality of reed wires wherein each reed wire is attached to a corresponding reed slider such that the reed wires extend below the reed sliders and are interposed between the warp yarns to guide the warp yarns during weaving;

means for moving each group frame along the reed frame;

means interconnecting the rail sliders within each group frame such that the rail sliders within each group frame move along the length of the rails in unison;

means interconnecting the linear actuator and the rail slider interconnecting means such that activation of the linear actuator causes the rail sliders within the group frame to be pulled along the lengths of the reed rails; and means for expanding the reed rails within each group frame in a direction perpendicular to the warp yarn axis.

11. The adjustable reed of claim 10, wherein the means for moving each group frame comprises:

a first gear attached along the length of one parallel side of the reed frame;

a plurality of group frame motors wherein each motor is attached to a corresponding outer edge of an end leg of each group frame; and a second gear rotatably attached to the group frame motor and engaging the first gear such that energizing the motor causes rotation of the second gear, thereby moving the group frame along the reed frame in a direction perpendicular to the warp yarn axis.

12. The adjustable reed as in claim 10, wherein the means for expanding the rails comprises:

a plurality of rail spreader motors, wherein each rail spreader motor is attached to a corresponding group frame;

a plurality of telescoping brackets wherein each bracket has a plurality of slidable segments forming an inner surface and an outer surface, and each slidable segment comprising the bracket is attached on the inner surface to an end of a corresponding reed rail within a group frame such that each group frame has a telescoping bracket at each end of the reed rails;

a plurality of rail expanders, each rail expander having a plurality of hinged segments forming an inner surface and an outer surface, wherein each hinged segment of a rail expander is rotatably connected at the inner surface of the hinged segment to the outer surface of the corresponding telescoping bracket segment, such that each telescoping bracket has a corresponding rail expander, whereby rotation of any hinged segment expands the rail expander laterally; and interconnecting means between at least one hinged segment of each rail expander and the corresponding rail expander motor for each group frame, for rotating that hinged segment of the rail expander such that the rail expander expands laterally.

13. The adjustable reed of claim 10, wherein each reed wire is slotted to accomodate and guide a warp yarn during weaving.

14. An adjustable reed for weaving warp and fill yarn fibers into fabrics, comprising:

a reed frame having at least two substantially parallel sides;

a plurality of group frames wherein each group frame further comprises:

at least two substantially vertical end legs, each leg having a top end, a bottom end and an inner surface; and a linear actuator interconnecting the two end legs near the top ends of each end leg, wherein the bottom of the end legs of the reed group frame are movably disposed on the reed frame so that each group frame moves along the reed frame in a direction perpendicular to the warp yarn axis;

a plurality of reed rails wherein each reed rail is mounted at each end to the inner surface of each of the end legs of the group frames such that each group frame contains a plurality of reed rails;

a plurality of reed sliders wherein each reed slider is slidably mounted on a corresponding reed rail;

a plurality of reed wires wherein each reed wire is attached to a corresponding reed slider such that the reed wires extend below the reed sliders and are interposed between the warp yarns to guide the warp yarns during weaving;

means for moving each group frame along the reed frame;

means interconnecting the rail sliders within each group frame such that the rail sliders within each group frame move along the length of the rails in unison;

means interconnecting the linear actuator and the rail slider interconnecting means such that activation of the linear actuator causes the rail sliders within the group frame to be pulled along the lengths of the reed rails; and means for skewing the relative positions of the rail sliders within each reed rail group.

15. The adjustable reed of claim 14, wherein the means for moving each group frame comprises:

a first gear attached along the length of one parallel side of the reed frame;

a plurality of group frame motors wherein each motor is attached to a corresponding outer edge of an end leg of each group frame; and a second gear rotatably attached to the group frame motor and engaging the first gear such that energizing the motor causes rotation of the second gear, thereby moving the group frame along the reed frame in a direction perpendicular to the warp yarn axis.

16. The adjustable reed as in claim 14, wherein the means interconnecting the rail sliders within each group frame is a telescoping rod having a plurality of slidable segments, wherein each segment is rotatably connected to a corresponding reed slider; and wherein the skewing means further comprises:

a skewing motor attached to the linear actuator such that activation of the linear actuator pulls the skewing motor along the length of the linear actuator; and means interconnecting the motor and a segment of the telescoping rod for turning the attached rod segment when the motor is energized, whereby rotation of the attached rod segment expands the telescoping rod to skew the sliders on the reed rails, thereby varying the relative positions of the attached reed wires to modify the fill yarn angle.

17. The adjustable reed of claim 14, wherein each reed wire is slotted to accomodate and guide a warp yarn during weaving.

18. An adjustable reed for weaving warp and fill yarn fibers into fabrics, comprising:

a reed frame having at least two substantially parallel sides;

a plurality of group frames wherein each group frame further comprises:

at least two substantially vertical end legs, each leg having a top end, a bottom end and an inner surface; and a linear actuator interconnecting the two end legs near the top ends of each end leg, wherein the bottom of the end legs of the reed group frame are movably disposed on the reed frame so that each group frame moves along the reed frame in a direction perpendicular to the warp yarn axis;

a plurality of reed rails wherein each reed rail is movably mounted at each end to the inner surface of each of the end legs of the group frames such that each group frame contains a plurality of reed rails;

a plurality of reed sliders wherein each reed slider is slidably mounted on a corresponding reed rail;

a plurality of reed wires wherein each reed wire is attached to a corresponding reed slider such that the reed wires extend below the reed sliders and are interposed between the warp yarns to guide the warp yarns during weaving;

means for moving each group frame along the reed frame;

means interconnecting the rail sliders within each group frame such that the rail sliders within each group frame move along the length of the rails in unison;

means interconnecting the linear actuator and the rail slider interconnecting means such that activation of the linear actuator causes the rail sliders within the group frame to be pulled along the lengths of the reed rails;

means for skewing the relative positions of the rail sliders within each reed rail group; and means for expanding the reed rails within each group frame in a direction perpendicular to the warp yarn axis.

19. The adjustable reed of claim 18, wherein the means for moving each group frame comprises:

a first gear attached along the length of one parallel side of the reed frame;

a plurality of group frame motors wherein each motor is attached to a corresponding outer edge of an end leg of each group frame; and a second gear rotatably attached to the group frame motor and engaging the first gear such that energizing the motor causes rotation of the second gear, thereby moving the group frame along the reed frame in a direction perpendicular to the warp yarn axis.

20. The adjustable reed as in claim 18, wherein the means interconnecting the rail sliders within each group frame is a telescoping rod having a plurality of slidable segments, wherein each segment is rotatably connected to a corresponding reed slider;

wherein the skewing means further comprises:

a skewing motor attached to the linear actuator such that activation of the linear actuator pulls the skewing motor along the length of the linear actuator; and means interconnecting the motor and a segment of the telescoping rod for turning the attached rod segment when the motor is energized, whereby rotation of the attached rod segment expands the telescoping rod to skew the sliders on the reed rails, thereby varying the relative positions of the attached reed wires to modify the fill yarn angle.

21. The adjustable reed as in claim 18, wherein the means for expanding the rails comprises:

a plurality of rail spreader motors, wherein each rail spreader motor is attached to a corresponding group frame;

a plurality of telescoping brackets wherein each bracket has a plurality of slidable segments forming an inner surface and an outer surface and each slidable segment comprising the bracket is attached on the inner surface to an end of a corresponding reed rail within a group frame such that each group frame has a telescoping bracket at each end of the reed rails;

a plurality of rail expanders, each rail expander having a plurality of hinged segments forming an inner surface and an outer surface, wherein each hinged segment of a rail expander is rotatably connected at the inner surface of the hinged segment to the outer surface of the corresponding telescoping bracket segment, such that each telescoping bracket has a corresponding rail expander, whereby rotation of any hinged segment expands the rail expander laterally; and interconnecting means between at least one hinged segment of each rail expander and the corresponding rail expander motor for each group frame, for rotating that hinged segment of the rail expander such that the rail expander expands laterally.

22. The adjustable reed of claim 18, wherein each reed wire is slotted to accomodate a warp yarn.

23. An adjustable reed for weaving warp and fill yarn fibers into fabrics, comprising:

a reed frame having at least two substantially parallel sides;

a plurality of group frames wherein each group frame further comprises:

at least two substantially vertical end legs, each leg having a top end, a bottom end and an inner surface; and a linear actuator interconnecting the two end legs near the top ends of each end leg, wherein the bottom of the end legs of the reed group frame are attached to the reed frame;

a plurality of reed rails wherein each reed rail is expandably mounted at each end to the inner surface of each of the end legs of the group frames such that each group frame contains a plurality of reed rails;

a plurality of reed sliders wherein each reed slider is slidably mounted on a corresponding reed rail;

a plurality of reed wires wherein each reed wire is attached to a corresponding reed slider such that the reed wires extend below the reed sliders and are interposed between the warp yarns to guide the warp yarns during weaving;

means interconnecting the rail sliders within each group frame such that the rail sliders within each group frame move along the length of the rails in unison;

means interconnecting the linear actuator and the rail slider interconnecting means such that activation of the linear actuator causes the rail sliders within the group frame to be pulled along the lengths of the reed rails;

means for skewing the relative positions of the rail sliders within each reed rail group; and means for expanding the reed rails within each group frame in a direction perpendicular to the warp yarn axis.

24. The adjustable reed as in claim 23, wherein the means for expanding the rails comprises:

a plurality of rail spreader motors, wherein each rail spreader motor is attached to a corresponding group frame;

a plurality of telescoping brackets wherein each bracket has a plurality of slidable segments forming an inner surface and an outer surface and each slidable segment comprising the bracket is attached on the inner surface to an end of a corresponding reed rail within a group frame such that each group frame has a telescoping bracket at each end of the reed rails;

a plurality of rail expanders, each rail expander having a plurality of hinged segments forming an inner surface and an outer surface, wherein each hinged segment of a rail expander is rotatably connected at the inner surface of the hinged segment to the outer surface of the corresponding telescoping bracket segment, such that each telescoping bracket has a corresponding rail expander, whereby rotation of any hinged segment expands the rail expander laterally; and interconnecting means between at least one hinged segment of each rail expander and the corresponding rail expander motor for each group frame, for rotating that hinged segment of the rail expander such that the rail expander expands laterally.

25. The adjustable reed of claim 23, wherein the means for moving each group frame comprises:

a first gear attached along the length of one parallel side of the reed frame;

a plurality of group frame motors wherein each motor is attached to a corresponding outer edge of an end leg of each group frame; and a second gear rotatably attached to the group frame motor and engaging the first gear such that energizing the motor causes rotation of the second gear, thereby moving the group frame along the reed frame in a direction perpendicular to the warp yarn axis.

26. The adjustable reed of claim 23, wherein each reed wire is slotted to accomodate and guide a warp yarn during weaving.

27. A method of weaving fabrics having varying fabric widths and fill yarn angles comprising the steps:

positioning an adjustable reed having groups of slotted reed wires into the path of warp yarns;

threading each warp yarn through a respective slotted reed wire to guide the position of each warp yarn; and simultaneously controlling the spacings of groups of reed wires during weaving to selectively modify the fabric width by varying reed wire spacing, and controlling the orientation of the reed wires in each reed wire group to selectively vary the fill yarn angle.

* * * * *